United States Patent [19]

Berstein

[11] Patent Number: 4,782,680

[45] Date of Patent: Nov. 8, 1988

[54] METHOD FOR ROLLING A SHAFT OR TENON HAVING CROSS-BORED HOLES

[75] Inventor: Garri Berstein, Erkelenz, Fed. Rep. of Germany

[73] Assignee: Wilhelm Hegenscheidt Gesellschaft mbH, Erkelenz, Fed. Rep. of Germany

[21] Appl. No.: 49,659

[22] Filed: May 13, 1987

[30] Foreign Application Priority Data

Jul. 19, 1986 [EP] European Pat. Off. ..... 86109930

[51] Int. Cl.[4] ..... B21H 1/00

[52] U.S. Cl. ..... 72/81; 72/365

[58] Field of Search ..... 72/80, 81, 102, 110, 72/111, 365, 366, 107

[56] References Cited

U.S. PATENT DOCUMENTS 2,663,344 12/1953 Burdick ..... 72/365
3,735,620 5/1973 Naumann .
4,299,017 11/1981 Gottschalk .
4,327,568 5/1982 Berstein .
4,561,276 12/1985 Berstein .

FOREIGN PATENT DOCUMENTS 2146994 3/1974 Fed. Rep. of Germany .
3037688 12/1982 Fed. Rep. of Germany .
2920889 6/1983 Fed. Rep. of Germany .
521122 9/1976 U.S.S.R. .

*Primary Examiner*—Lowell A. Larson
*Attorney, Agent, or Firm*—W. G. Easse; D. H. Kane, Jr.

[57] ABSTRACT

The milling of work pieces having at least one bore in the surface to be milled by roller action, is performed by controlling the size of the force applied to the work piece surface in accordance with the rotation of the work piece and in accordance with the location of the bore. The control is such that the rolling force or pressure applied when the roller contacts the bore is smaller than the rolling force or pressure when the roller contacts the work piece surface outside the bore. The rolling force may even be applied in a pulsating manner in the zone of a bore. A minimum of the applied rolling force is reached at the latest when the roller passes over the bore diameter. In this manner undesirable deformations of the work piece surface, especially in a ring zone around the bore, are avoided.

12 Claims, 2 Drawing Sheets

F
F(φ)
FMIN
a)
0
B
360°
φ
F
F(φ)
FMIN
b)
0
B
360°
φ
F
F(φ)
c)
FMIN
0
B
360°
φ
F
D
D'
F(φ)
d)
FMIN
0
B
360°
φ

F

Fp'
Fp
C
F'(φ)MAX.
F'(φ)
A
0°
D
B
D'
φ

METHOD FOR ROLLING A SHAFT OR TENON HAVING CROSS-BORED HOLES

FIELD OF THE INVENTION

The invention relates to a method for rolling shafts or tenons having at least cross-bored hole, in a plunge rolling operation with at least one rolling pin or forming roller, and at least one support roller. Each forming roller presses against the surface of the shaft with a specific desired rolling force during the rotation of the shaft.

DESCRIPTION OF THE PRIOR ART

Shafts having cross-bored holes ay, for example, be the bearing journals of crankshafts. Methods and apparatus for generally rolling shafts, especially crankshafts, are known, for example from German Patent Publication (DE-PS) No. 2,146,994 corresponding to U.S. Pat. No. 3,735,620 (Naumann). These rolling machines and the associated methods have been proven to be effective for rolling of closed or uninterrupted shaft surfaces. The tools associated with such apparatus typically function in the so-called plunge rolling method. However, when prior art apparatus and the associated tools are used for rolling over cross-bores, shape deformations are produced which are undesirable and even not permissible. These non-permissible deformations are formed especially around the edge of a cross-bore.

Another apparatus of this type is disclosed in the Soviet Union Patent Publication (SU-PS) No. 521,122, which shows in FIG. 2 a bearing journal having a cross-bore, which is being rolled by the forming roller (11), whereby the above mentioned cross-bore is being rolled over by these forming rollers (11). There is no disclosure in this Russian Patent how to prevent the undesirable and unallowable shape deformations in the region of the cross-bore, caused by the rolling operations.

A rolling mill machine for crankshaft bearing journals, having a rolling force control means, is disclosed in the German Patent Publication (DE-PS) No. 3,037,688 corresponding to U.S. Pat. No. 4,561,276 (Berstein). The rolling force is controlled during the rotation of the crankshaft bearing journal for the purpose of bending over the "Kurbelwellenspiegel". There is no hint or indication of any connection between the rolling force control disclosed in (DE-PS) No. 3,037,688 and the rolling of circumferential ranges of crankshaft journals having cross-bored holes. No specific rolling force regulation or control to compensate for the reduced surface area in circumferential ranges of cross-bored holes is disclosed. The control for bending over the "Kurbelwellenspiegel" would likely lead to undesirable surface deformations in areas adjacent to cross-bored holes because the known control does not pay any attention to these holes.

German Patent Publication (DE-PS) No. 2,920,889, corresponding to U.S. Pat. No. 4,327,568 discloses a rolling method which employs a pulsating rolling force which is applied during the entire rolling process. The (DE-PS) No. 2,920,889 does not make any suggestion that it may be advantageous to modulate the force pulsation to achieve beneficial effects while rolling work pieces having cross-bored holes. In other words, no provision is made for applying a pulsating rolling force over at least a certain circumferential or angular range of a work piece while applying a static rolling force over at least one other angular range of a work piece.

U.S. Pat. No. 4,299,017 (Gottschalk) describes an apparatus for smooth rolling bearing seats of crankshafts. One of the rolling tools is supported by a rocker arm. Such a machine is suitable for operation in accordance with the present invention.

OBJECTS OF THE INVENTION

In view of the foregoing it is the aim of the invention to achieve the following objects singly or in combination:

to provide a method for rolling a shaft so as to attain a desired level of surface smoothness while maintaining the pre-machined shape of the shaft with a high degree of accuracy even if the shaft is provided with cross-bores;

to provide such a rolling method for shafts having one or more cross-bored holes so that the entire surface of the shaft is rolled without producing any unallowable shape deviations or deformations, especially in the regions along the edges of the cross-bored holes;

to modulate the rolling force applied to the shaft to be rolled by such a rolling method in such a manner that a reduced rolling force is applied to the shaft surface in the area of the cross-bores so as to prevent shape deformations;

to carry out such rolling force control in a force controlled manner, and not in a shape-controlled or rolling drum displacement-controlled manner, to ensure that a prescribed rolling force is applied, regardless of the shaft shape tolerances or material inhomogeneities; and to control the rolling force in such a rolling method in a pulsating manner, so that a work piece may be rolled with a static force over at least one angular circumferential range, and with a pulsating force over at least one other angular circumferential range.

SUMMARY OF THE INVENTION

The above objects have been achieved in a method for rolling a shaft or tenon having cross-bored holes, according to the invention, in that the rolling force of a rolling drum which is smooth-rolling a shaft, is reduced as the rolling drum rolls over the circumferential range of the diameter of a cross-bored hole. The rolling force acting upon the shaft in the region of a cross-bore is reduced to a minimum at the latest in the region of the central diameter of the bored hole. The rolling operation of such shafts in the plunge rolling method is achieved in a force controlled manner so that a determined force application of the rollers or rolling drums against the work piece is actually achieved.

In shape controlled rolling methods the risk exists that the rolling force actually applied to the work piece may vary or become unallowably large or small due to size and shape tolerances of the work piece. However, to achieve the force controlled rolling according to the invention, a rolling force control is provided so that a smaller rolling force is applied in the area of the bored hole, that is when the respective rolling drum rolls over the bored hole. This reducing in rolling force which keeps the rolling force per unit area being rolled is not detrimental to the rolling operation because the effect is not primarily dependent upon the total rolling force, but instead upon the specific rolling pressure applied to each surface area. As the rolling drum rolls over the area of the bored hole, the contact surface area being rolled between the roller and the work piece is reduced, whereby, if a constant total rolling force is applied, the specific surface pressure increases. As a result, the work piece surface deformation becomes larger in conventional rolling operations. Thus, as the contact surface area of the surface to be rolled decreases, the applied total rolling force must be proportionately decreased for maintaining a constant rolling pressure or a specific rolling force.

The effect to be strived for is the control of the specific rolling force during the over-rolling of a bore cross-section so that undesirable shape deformations of the work piece are avoided. The necessary rolling parameters are known or may be determined through experiments for any specific work piece. Therefore, it is also possible to provide information regarding the rolling force necessary in the range of a bored hole or, if necessary, to directly determine the correct rolling force to be applied in the range of the bored hole through experimentation. Thus, the rolling force control over one revolution of the work piece proceeds in a cycle such that the rolling force in effect over the range of a bored hole is less than the rolling force applied over the rest of the circumference. The rolling force shall reach its minimum within the range of the bored hole. In this manner an unallowable increase in the specific applied rolling pressure of the rolling drum against the work piece in the work piece surface area adjacent to or around a cross-bored hole, is prevented.

According to one embodiment of the invention it is provided that the reduction of the rolling force in the bored hole range continues until the actual rolling force per surface area corresponds to that specific rolling force which is required for achieving the desired surface quality. This feature achieves a good match with the remaining adjacent areas to be rolled and any arising surface shape deformations, if any are caused at all, in the regions of the cross-bored holes remain allowably small.

In a simple embodiment the minimum rolling force is applied throughout the entire range of the bored hole. In other words, the minimum rolling force is constant in the bored hole range. The rolling force control necessary for such a force regulation is quite simple and still achieves a satisfactory rolling result, especially for shafts or journals having cross-bores of a small diameter. Even with such a simple rolling force control unallowable shape deformations of the shaft surface are preventable for cross-bores of a sufficiently small bore diameter. A simple experimental test is sufficient to determine if the diameter of any cross-bore is sufficiently small for successfully utilizing this simplified method and control. The experimental test merely involves running a sample through the machine and check the result. This is not wasteful because usually mass production is involved.

Another simple embodiment of the invention provides that, as a rolling drum approaches a cross-bored zone, the total rolling force is reduced to such an extent that the minimum rolling force is applied at the latest when the rolling drum reaches the middle of a bore that is to say, the drum spans the greatest bore or hole diameter, as compared to smaller chord lengths. The minimum rolling force applied at the middle of the hole is such that it produces a specific rolling force or rolling pressure on the shaft surface around the bore hole, corresponding to that applied to the remaining zones of the shaft surface. Such a method of force regulation also utilizes a relatively simple rolling force control, for example, in the form of a simple force switching by means of a hydraulic device.

According to another feature of the invention the rolling force reduction starts at least within a circumferential ring zone having a width of about 0 to 3 mm around the edge of the cross-bored hole. This type of rolling force reduction assures that at a desired location, such as the edge of the hole, a desired force reduction is actually achieved. Furthermore, any undesirable shape deformations caused by a too rapid rolling force reduction are prevented by this feature.

Similarly, after the rolling drum has passed over the hole, the rolling force shall be increased to a maximum rolling force value at the latest within 3 mm downstream of the hole as viewed in the rolling direction. The feature assures that undesirable shape deformations due to a too rapid increase in the rolling force, are prevented. Simultaneously, it is assured that the rolling force outside the hole has the force value required for applying the specific rolling force or rolling pressure to the remaining non-bored regions of the work piece.

The invention further teaches that any changes in the rolling force are limited to such force magnitudes and rates of change that within the range where the rolling force changes, the required shape tolerances and the required surface parameters are maintained. The limits within which such force changes may be carried out may be determined through simple experimentation. The prescribed values which must be maintained include the required shape tolerance values and the prescribed surface parameters. Since a rolling force modulation is required for rolling over areas of cross-bored holes, and since such a rolling force modulation can only be achieved at a finite rate of change, the associated tools and machine elements must have the capacity for achieving the force modulation at a desired magnitude and rate of change for assuring the necessary shape tolerances and surface parameters.

Furthermore, according to the invention it is suggested that at any time during the rolling operation at most one rolling drum is within the circumferential range of a cross-bored hole. In this manner uncontrolled reactions and uncontrolled force applications are prevented.

A further embodiment according to the invention provides that a pulsating rolling force larger than zero is applied to the rolling drum in the circumferential direction at least in a zone covered by the bored hole diameter. The remaining non-bored circumferential surface of the work piece is rolled with a non-pulsating rolling force. The pulsating rolling force applied in the hole zone is pulsed at a frequency of 30 to 300 Hz and with an amplitude of 10 to 100% of its local minimum value. The rolling speed is matched or adjusted so that the lowest points on the work piece surface caused by the impressions of the rolling drum at the maximum force value, as it would arise under static loading, are spaced from one another by a spacing which is not larger than two times the impression width. Because the pulsating rolling force is never equal to zero, the pulsating rolling force is in effect a super-position of a static constant or base rolling force and of a pulsating or oscillating rolling force having the given frequency and an amplitude. As compared to a static rolling force having the maximum value of the amplitude of such a pulsating rolling force, the pulsating rolling force achieves a considerable increase in the strengthening depth and micro-hardness. The work piece deformation caused by the pulsating tool remains essentially in the elastic range as far as it can be allocated to the pulsation. Measurable surface waves or ripples are not produced in this manner in the work piece. Rather, the surface quality achievable by known smooth rolling methods is easily achieved by the present method. Furthermore, it is possible to reduce the static rolling force to a value comparable to the force applied over the remaining non-bored circumferential range of a statically rolled shaft or work piece so that unallowable shape deformations over the circumferential range of a cross-bored hole may again be avoided.

The invention also provides that the minimum value of the pulsating rolling force corresponds to the value necessary for achieving a desired rolled smoothness, and that the maximum value of the pulsating rolling force corresponds to the value necessary for achieving a desired hardened depth and/or the value necessary to achieve the desired increase in micro-hardness. These maximum and minimum force values thus provide limit values which permit obtaining a desired rolling result.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

All the Figures are Cartesian plots of the rolling force F on the ordinate versus the rotational angle ($\rho$) of a work piece on the abscissa, thus $F(\rho)$. FIGS. 1*a* to 1*d* show a rotational angle range ($\rho$) from 0° to 360°. The force plot F thus corresponds to the progression of force applied over one work piece rotation. An angular range B corresponds to the angle or circumferential range subtended by the open end of a cross-bored hole in the work piece. According to FIG. 1*a*, the rolling force F remains essentially constant throughout a work piece rotation of 360°, except a reduction in the rolling force F takes place only within the range B. The force modulation progresses sinusoidally to a minimum value $F_{min}$. The minimum force value $F_{min}$ is supplied at least approximately at the location of the largest diameter of the bored hole, that is, at the angular location of the center of the hole. The minimum force value $F_{min}$ over the hole has a magnitude such that a specific rolling force or rolling pressure is applied on the surface areas outside the bored holes. This specific rolling force or pressure corresponds to the specific rolling force or rolling pressure caused by the maximum force applied to the work piece surface outside of the bored hole range B. Alternatively, the specific rolling force may deviate slightly from this maximum value established outside the range B to such an extent that unallowable shape deformations of the work piece are avoided. The reduction of the rolling force as a sinusoidal function ensures that corresponding to the position of the rolling drum over the bored hole cross-section the specific rolling force or rolling pressure in the respective momentarily rolled region adjacent to the bored hole remains at least approximately constant over the entire bore hole range B. In other words, the total rolling force is reduced sinusoidally as the surface area contacted by the rolling drum similarly is reduced sinusoidally as the rolling drum advances over the angular range B as the work piece rotates.

Figure 1:
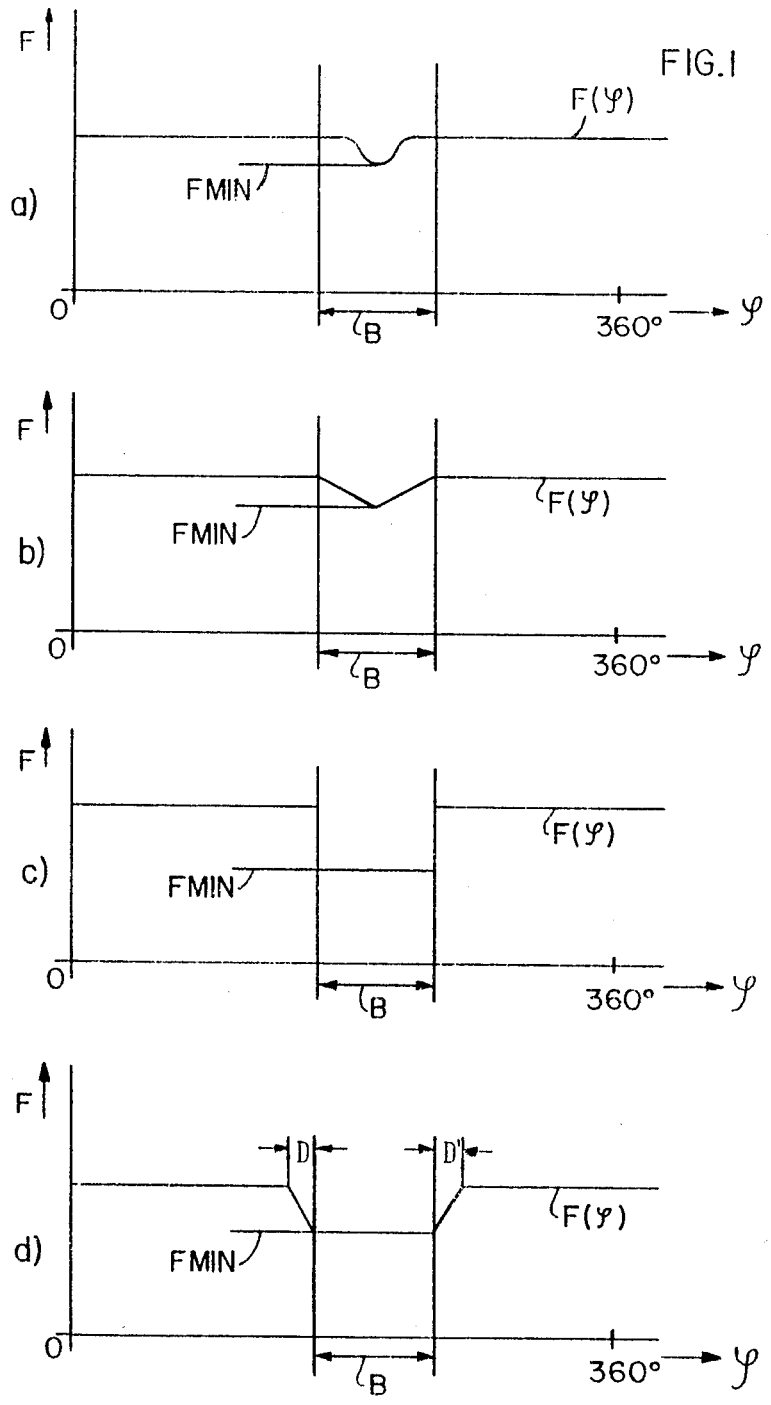
FIG. 1*a* is a plot of the rolling force F as a function of the rolling angle $\rho$ of the work piece showing a sinusoidal decrease and subsequent increase from a maximum force value to a minimum value $F_{min}$ within the angular range B of a cross-bored hole in a work piece.
FIG. 1*b* is a plot of $F(\rho)$ similar to FIG. 1*a* but showing a linear decrease to a minimum and linear increase of the force F within the angular range B.
FIG. 1*c* is a plot similar to FIG. 1*a*, but showing a step function decrease and increase of the force F within the angular range B.
FIG. 1*d* is a plot of the rolling force F similar to the plot of FIG. 1*a*, but showing a linear decrease in force F over a range adjacent to the angular range B and a constant minimum force $F_{min}$ within the angular range B followed by a linear increase outside the range B.

Even an approximation of the force function $F(\rho)$ according to FIG. 1*a* may already be sufficient to achieve the desired result. Such an approximation is shown in FIG. 1*b*, wherein the rolling force function $F(\rho)$ decreases linearly to a minimum value $F_{min}$ in the center of the range B and then again increases linearly to the original maximum value within the range B. The minimum force $F_{min}$ is applied at least approximately at the center of the range B. Such a progression or characteristic of the force F over the rotational angle ($\rho$) can be sufficient to achieve the desired smooth-rolling results without causing unallowable shape tolerances of the work piece.

FIG. 1*c* shows a further simplification of the progression of the rolling force $F(\rho)$ which may still lead to satisfactory results, especially for cross-bores of small diameter. The force F is reduced in one step to the minimum value $F_{min}$ immediately at the beginning of the range B. The minimum value $F_{min}$ is then maintained constant throughout the range B until the end of the range B where the rolling force is increased in a step function to the original force value.

Due to various extraneous limiting conditions such as the degree of ductility of the material to be rolled, the inertial characteristics of the rolling mill and of the rolling mill control, the force function $F(\rho)$ according to FIG. 1*c* may not be appropriate. In such cases the force function may be replaced by a force characteristic $F(\rho)$ according to FIG. 1*d*.

In FIG. 1*d* the force is maintained at a minimum value $F_{min}$ throughout the angular range B of the cross-bored hole, as in FIG. 1*c*, however, the force reduction is not carried out in a stepwise manner, but instead in a linear manner in a slight lead-in zone D. Thus, the force is reduced linearly before the angular range B is reached so that the force is assuredly at a minimum value $F_{min}$ at the beginning of the range B. Similarly, the force is linearly increased after the end of the range B in a lead-out zone D' to attain its original force value a slight angular distance beyond the end of the range B. It is also possible to attain the minimum force $F_{min}$ already before the angular range B begins. The rate of force reduction or increase may be adjusted as desired.

Figure 2:
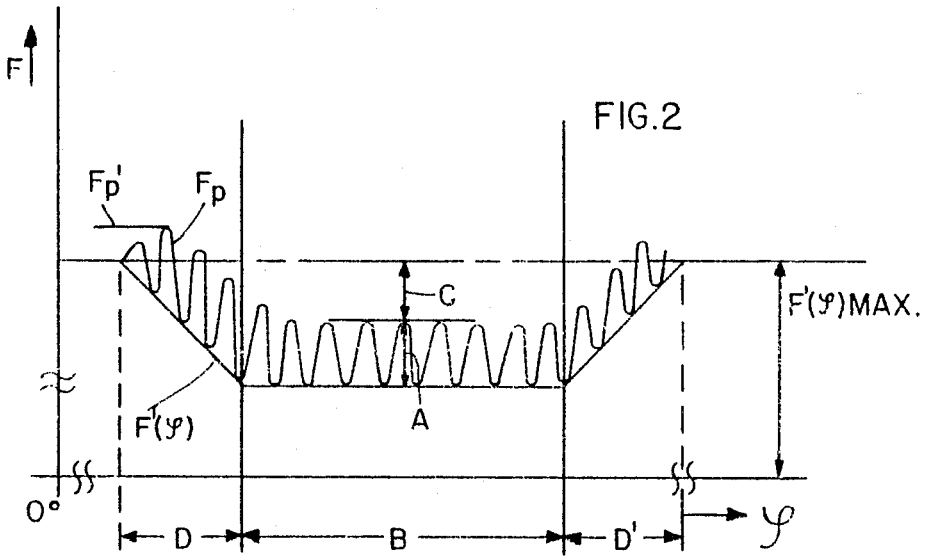
FIG. 2. is a plot similar to the force plot of FIG. 1*d*, but showing a pulsating rolling force $F_p$ superimposed on a static rolling force in the angular range B and in a lead-in and lead-out zone in front of and behind the range B.

FIG. 2 shows a force versus angle plot similar to the plot of FIG. 1*d*, but with the zones D, B, and D' emphasized by an enlarged scale. FIG. 2 shows a base force $F'(\rho)$ which may correspond to the force $F(\rho)$ shown in FIGS. 1*a* to 1*d*. In the range (B) and in the adjacent lead-in and lead-out ranges or zones, a pulsating rolling force $F_p$ having an amplitude A is superimposed on the base force $F'(\rho)$. The amplitude A is in the range of about 10 to about 100% of the respective local minimum value of $F'(\rho)$. Due to the superposition, peak force values $F'_p$ may actually be higher than the maximum rolling force $F'(\rho)_{max}$ in the static range where there is no superposition. Nonetheless, unallowable shape deformations may be avoided in that any work piece deformations which may be caused by the pulsation are essentially within the elastic deformation range of the material. Furthermore, because the pulsating force has a larger effect on the degree of hardening than a static rolling force having the maximum magnitude of the amplitude, it is quite possible to maintain the maximum value of the pulsating rolling force by an amount C below the static rolling force value within the range B.

The method according to the invention may be carried out by conventional rolling mills, for example, as described above. However, it is necessary that the rolling force control arrangement, or rather its impulse function during one revolution of the work piece can be controlled in synchronism with the position of the cross-bored hole as it moves past the rolling drums of the rolling mill tool. In other words, the rolling force reduction and pulse superposition must occur in the zone B or in the zones D, B, D'. It is advantageous to assure that the rolling process does not begin in an angular orientation of the work piece in which a rolling drum lies within the angular range of a cross-bored hole. If such an alignment for the start of the rolling process is avoided, the control for the rolling force may be simplified and the shape accuracy of the work piece may be improved.

Furthermore, attention must be paid to the fact that at any time only one single rolling drum is rolling over the circumferential or angular range of a cross-bored hole. If a rolling mill tool comprises several rolling drums, the angular arrangement of the angular position of the cross-bored holes of the work piece to be rolled must take into account the arrangement of the rolling drums or vice versa. Furthermore, in such rolling mill tools the ratio of diameters of the rolling drums on the one hand, and the support rollers also contacting the work piece on the other hand, must be such that a plastic deformation or reforming of the work piece surface is caused exclusively by the rolling drums and not by the supporting rollers also contacting the work piece.

Practical tests of the method according to the invention have shown that it is possible to smooth-roll especially the bearing journals of crankshafts having cross-bored holes with satisfactory results without simultaneously causing unallowable shape deviations of the bearing journals in the area of the cross-bored holes.

Although the invention has been described with reference to specific example embodiments, it will be appreciated that it is intended to cover all modifications and equivalents within the scope of the appended claims.

What I claim is:

1. A method for milling with milling roller means a surface of a work piece having at least one bore defining a bore range on said surface of said work piece, comprising the following steps:

(a) causing relative rotation between said work piece and said milling roller means while simultaneously applying a compression force between said milling roller means and said work piece surface, (b) controlling the size of said compression force applied between said milling roller means and said work piece surface in accordance with such a control function that a starting static compression force applied to said work piece surface outside said bore range is reduced to a lower compression force in said bore range of said surface where said bore is located, so that the rolling force per unit area being rolled remains substantially constant, and (c) synchronizing said controlling of said compression force with said relative rotation so that said lower compression force reaches its minimum at the latest when said milling roller means align with a diameter of said bore.

2. The method of claim 1, wherein said reducing of said compression force in said bore range is limited until a specific compression in said bore range corresponds to a given specific compression which will result in a required surface finish quality of said work piece surface.

3. The method of claim 1, wherein said control function reduces said starting static compression force linearly in said bore range until the center of said bore range is reached, whereupon the reduced compression force is increased linearly until said starting static compression force is reached again outside said bore range.

4. The method of claim 1, comprising reducing, in accordance with said control function, said starting static compression force in a step to said minimum of said compression force, maintaining said minimum compression force constant throughout said bore range, and then increasing said minimum compression force again in a step back to said starting static compression force outside said bore range.

5. The method of claim 1, comprising reducing, in accordance with said control function, said starting static compression force in such a way that said compression force is reduced, at the latest when said milling roller means reaches said bore range, to a specific compression force effective in said bore range and corresponding in its effect to a specific compression force applied to said work piece surface outside said bore range.

6. The method of claim 1, wherein said reducing begins in a zone (D) ahead of said bore range, said zone having a width of about 0 mm to about 3 mm in the circumferential direction of said work piece.

7. The method of claim 6, further comprising increasing said lower compression force again in a zone (D') downstream of said range in such a way that the starting static compression force is reached again within about 3 mm (zone D') downstream of said bore range in the circumferential direction of said work piece.

8. The method of claim 1, wherein said control function reduces said starting static compression force and increases said lower compression force again at such a reduction rate and at such a rate of increase that the required shape tolerances and the required surface quality values are satisfied.

9. The method of claim 1, wherein said synchronizing is performed in such a way that at any random instance only one milling roller passes through said bore range.

10. The method of claim 1, further comprising modulating said lower compression force at least within said bore range for producing a pulsating compression force differing from zero and performing said milling outside said bore range with said static starting compression force, said pulsating having a frequency in the range of about 30 to about 300 Hz and an amplitude of about 10% to about 100% of said lower compression force in said bore range, and wherein a rolling speed caused by said relative rotation is so selected that lowest points of depressions formed in said work piece surface by a maximum value of said pulsating compression force have an on-center spacing corresponding to twice the width of a so formed depression at the most.

11. The method of claim 10, wherein said modulating is applied to said lower compression force in a zone (D) leading toward said bore range, in said bore range (B), and in a zone (D') leading out of said bore range.

12. The method of claim 10, wherein said pulsating compression force is so controlled that its minimum value assures a desired surface quality of said work piece surface, and so that its maximum value assures a required work hardening depth corresponding to a respective increase in the micro-hardness of the work piece surface.

* * * * *